United States Patent [19]

Jenkins et al.

[11] Patent Number: 4,709,820

[45] Date of Patent: Dec. 1, 1987

[54] SHEET DISPENSING APPARATUS

[75] Inventors: Stuart M. Jenkins, Sussex; Michael S. Spencer, Portsmouth, both of England; Ross Mayfield, Torrance, Calif.

[73] Assignee: De La Rue Systems Limited, London, England

[21] Appl. No.: 710,964

[22] Filed: Mar. 12, 1985

[30] Foreign Application Priority Data

Mar. 12, 1984 [GB] United Kingdom ..... 8406374

[51] Int. Cl.[4] ..... B07C 5/36; B65H 7/00

[52] U.S. Cl. ..... 209/534; 271/187; 271/315; 414/43

[58] Field of Search ..... 209/534; 235/379; 271/187, 315; 414/43; 194/DIG. 26

[56] References Cited

U.S. PATENT DOCUMENTS

| | | | |
|---|---|---|---|
| 4,363,584 | 12/1982 | Kokubo | 271/315 |
| 4,398,088 | 8/1983 | Hirose et al. | 209/534 |
| 4,434,359 | 2/1984 | Watanabe | 235/379 |
| 4,465,193 | 8/1984 | Kokubo et al. | 235/379 |
| 4,465,925 | 8/1984 | Goi | 209/534 |
| 4,479,049 | 10/1984 | Hirose | 209/534 |
| 4,482,057 | 11/1984 | Shawen et al. | 209/534 |
| 4,602,332 | 7/1986 | Hirose et al. | 235/379 |

FOREIGN PATENT DOCUMENTS

| | | | |
|---|---|---|---|
| 2005639 | 10/1978 | United Kingdom . | |
| 2111951 | 7/1983 | United Kingdom | 414/43 |
| 2123592 | 7/1983 | United Kingdom . | |
| 2135977 | 9/1984 | United Kingdom . | |
| 2139602 | 11/1984 | United Kingdom . | |

*Primary Examiner*—Robert B. Reeves
*Assistant Examiner*—Donald T. Hajec
*Attorney, Agent, or Firm*—Cushman, Darby & Cushman

[57] ABSTRACT

An apparatus for dispensing sheets, including cash, which comprises first conveying elements for dispensing sheets along a feed path to a stacking position; first detection device for detecting unsuitable sheets; and diverting elements for diverting detected unsuitable sheets along a reject path to a dump. Stacking elements are positioned downstream of the diverting elements for stacking sheets at the stacking position. Second conveying elements are provided for selectively delivering the stacked sheets to a dispense outlet or along a reject path to the dump.

6 Claims, 3 Drawing Figures

SHEET DISPENSING APPARATUS

The invention relates to sheet dispensing apparatus particularly for dispensing banknotes.

There is an increasing demand for accurate sheet dispensing apparatus particularly in the field of dispensing banknotes where it is clearly very important that a correct quantity of banknotes are dispensed.

In accordance with one aspect of the present invention, sheet dispensing apparatus comprises comprising first conveying means for dispensing sheets along a feed path to a stacking position; stacking means comprising a rotatable member having a plurality of radially outwardly opening slots for receiving sheets from the feed path; and pivotable stripper means comprising a movable conveyor which is pivotable between a first position in which it acts to strip sheets from the rotatable member to form a stack of sheets and a second position in which the stack of sheets is sandwiched between the stripper means and second conveying means, the stripper means being movable in the second position in cooperation with the second conveying means to transport the stacked sheets towards an output station.

By forming the stripper means as a conveyor which can be used to transport the stacked sheets to an output station, a reduction in the size of the overall sheet dispensing apparatus is achieved.

Prior to the stacked sheets reaching the output station, further diverting means may be provided downstream of the stacking position to divert the stacked sheets either to the output station or to a dump.

Preferably, the sheet receiving slots are defined by a plurality of radially outwardly extending tines.

In accordance with a second aspect of the present invention, sheet dispensing apparatus comprises first conveying means for dispensing sheets along a feed path to a stacking position; first detection means for detecting unsuitable sheets; diverting means comprising a movable guide cooperating with the first conveying means to guide sheets along the first conveying means and movable in response to an output signal from the first detection means to divert detected unsuitable sheets along a first reject path to a dump; stacking means downstream of the diverting means for stacking sheets at the stacking position; and second conveying means for selectively delivering the stacked sheets to a dispense outlet or along a second reject path to the dump.

The first detection means may detect sheets as being unsuitable if for example two or more sheets are fed simultaneously, a folded or damaged sheet is fed or the sheet fails an authenticity test. The present invention enables not only this test or tests to be made but enables the subsequent stack of sheets to be rejected and this is important if for example the user decides he does not after all wish to receive the sheets or if there has been some error in the feed and an incorrect number of sheets have been fed to the stack.

This second aspect of the invention provides a common dump which reduces cost and simplifies use of the apparatus.

Preferably, part of the second reject path is formed by the first reject path. This provides a particularly convenient and compact apparatus which is also simple in construction since it can utilise the same conveying means for the first reject path and part of the second reject path and thus reduce the chances of jamming or other malfunctions.

The diverting means may comprise a pivoted guide member which acts to divert sheets away from the first path into the reject path if the first detection means detects the passage of for example two overlapping sheets.

Preferably, the stacking means comprises a rotatable member having a plurality of radially outwardly extending tines for receiving sheets from the feed path; and stripper means cooperating with the rotatable member for stripping sheets from the rotatable member to form a stack of sheets, the stripper means being pivotable from a first position in which sheets are stripped from the rotatable member to a second position in which the stack of sheets is urged into engagement with the second conveying means.

This again has the advantage of enabling compact apparatus to be constructed by using a dual function stripper means.

Although the stripper means could be provided by a plate member, preferably, the stripper means comprises one or more movable conveyers.

Two examples of banknote dispensing apparatus in accordance with the present invention will now be described with reference to the accompanying schematic drawings, in which.

Figure 1:
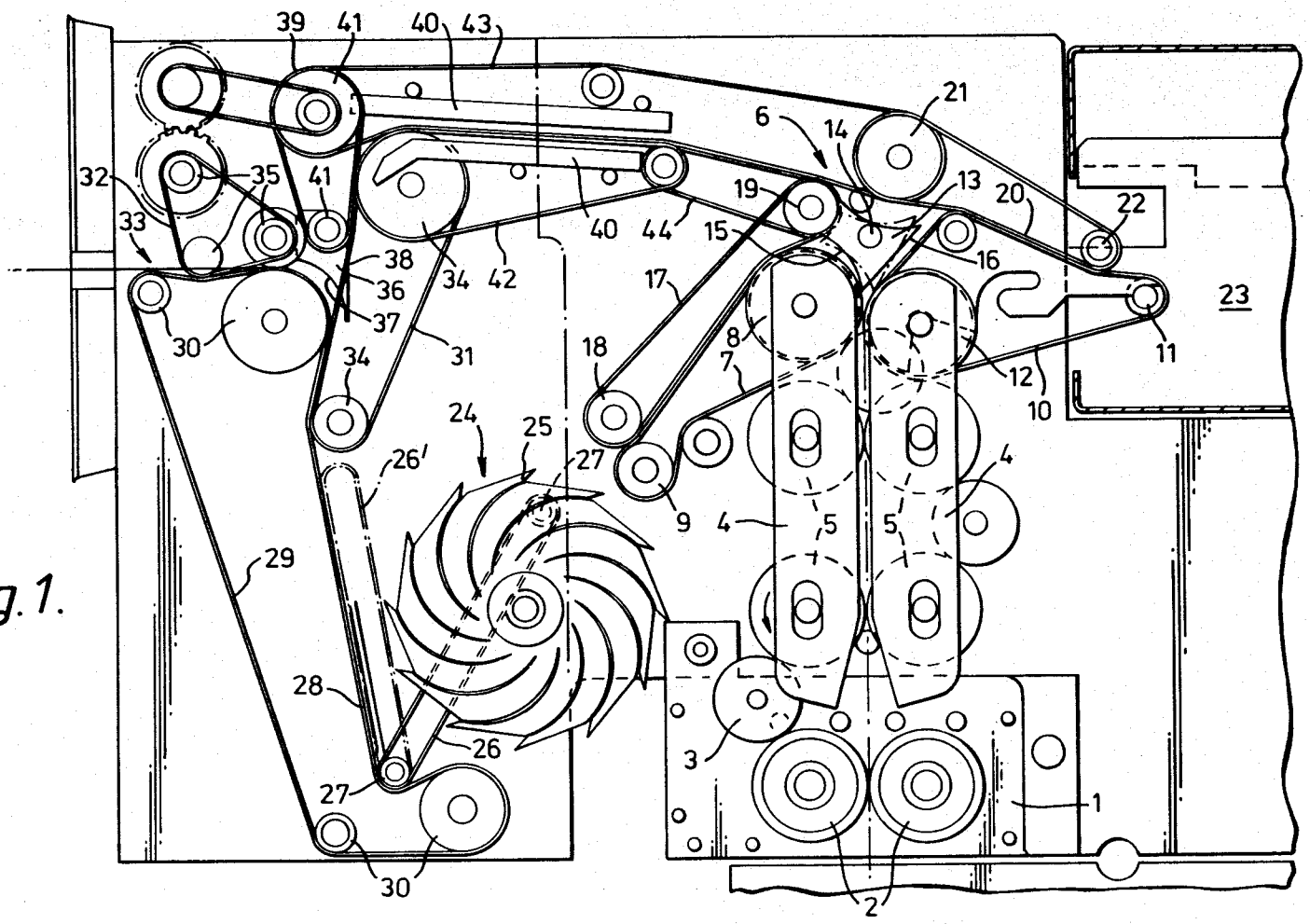
FIG. 1 illustrates part of one example of dispensing apparatus.

The banknote dispensing apparatus shown in FIG. 1 comprises a conventional detection module 1 to which banknotes are fed from cassettes (not shown) by conveying means (not shown). The module 1 includes a pair of rollers 2, driven via a drive gear 3 by a motor (not shown), between which the banknotes pass and the separation of which is monitored. If the separation between the two rollers 2 exceeds a threshold indicating the passage of overlapping or folded notes, an output signal is generated by the module 1. Banknotes are guided from the module 1 between a pair of guides 4 under the action of rollers 5 driven via the gear 3 to a diverting station 6.

The diverting station 6 comprises a belt 7 mounted around rollers 8, 9; a belt 10 mounted around rollers 11, 12; and a guide member 13. The guide member 13 is pivotally mounted at 14 to a housing part of the apparatus (not shown). The guide member 13 has a first curved guide surface 15 facing the roller 8 and a second planar guide surface 16 facing the roller 12. In the position shown by dashed lines in FIG. 1, the guide member 13 is arranged so that notes which reach the diverting station 6 from the module 1 are guided around the roller 8 and between the belt 7 and a belt 17 mounted about rollers 18,19.

If the module 1 indicates the passage of overlapping banknotes, the guide member 13 will be caused to pivot to the position shown in solid lines in FIG. 1 in which the guide surface 15 engages the belt 7 and thus the unsuitable banknotes will be guided around the roller 12 and between the belt 10 and a belt 20 mounted around rollers 21, 22. These unsuitable notes will be fed by the belts 10, 20 to a dump cassette 23 which is partially illustrated in FIG. 1.

Figure 2:
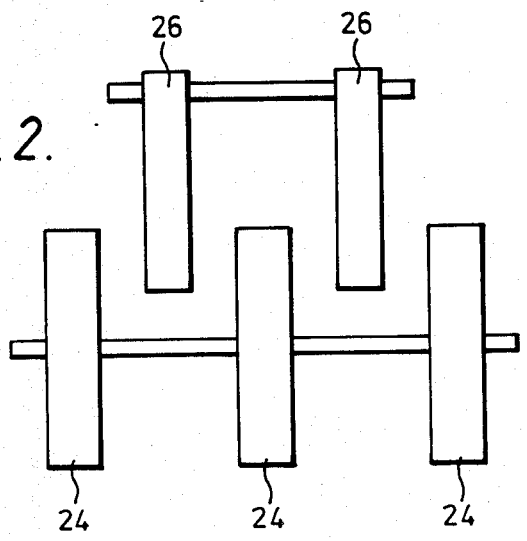
FIG. 2 illustrates the stacking means of the apparatus shown in FIG. 1.

Banknotes that are suitable are fed by the belts 7, 17 to a conventional rotatable member comprising three conventional stacking wheels 24 having curved radially outwardly extending tines 25 defining sheet receiving slots 25'. The stacking wheels 24 rotate in an anticlockwise direction and carry notes around the wheels into engagement with belts 26 (FIG. 2) mounted around rollers 27. The engagement of each note with the belts 26 causes the note to be stripped from the stacking wheels 24 and to be stacked in a stack 28 resting against a belt 29 which is stationary at this time. The belt 29 is mounted around rollers 30.

When the nots have been stacked in the stack 28, the belts 26 are pivoted in anti-clockwise direction into the position shown at 26' in which the stack 28 is urged against the belt 29. If the number of banknotes in the stack 28 is correct, the belts 26, 29 are rotated to dispense the stack 28 between belts 31,32 to a dispense outlet 33. (The belt 31 is entrained about rollers 34 while the belt 32 is entrained about rollers 35.)

A guide member 36 is pivotally mounted to the apparatus and has a curved guide surface 37 facing the adjacent roller 30. In the position shown in FIG. 1, the guide member 36 guides the stack of sheets to the dispense outlet 33. If the user decides he does not wish to receive the stack of sheets or detection apparatus has detected that the stack of sheets is unsuitable for some reason, the guide member 36 is pivoted so that the guide surface 37 engages the belt 29 and the stack of sheets 28 instead will be guided between a further guide surface 38 and the drive belt 31, between the belt 31 and a further belt 39 to a feed path defined between a pair of guide surfaces 40. The belt 39 is entrained about rollers 41. The stack of sheets 28 is moved between the guide surfaces 40 since it will be sandwiched between a pair of belts 42, 43. The stack of notes 28 will be passed from the guide surfaces 40 between the belt 43 and a belt 44 to the diverting station 6 where it will then pass to the dump cassette 23 between the belts 10, 20. In this way, part of the reject path for the stack of sheets 28 is the same as the reject path for the unsuitable sheets fed from the module 1.

Conveniently, the apparatus will be controlled by a conventional microprocessor which is responsive to output signals from the module 1 and to input signals by a user to control the feeding of notes to the stack 28. Although not shown, the apparatus may further comprise means for counting the notes in the stack 28 and if a number of notes is incorrect then the stack may automatically be fed to the dump cassette 23. In addition, as previously mentioned, the stack 28 may be rejected at the command of a user.

Each of the belts and the stacking wheels may be driven by a conventional motor (not shown) under the control of the microprocessor. The position of each guide member 13, 36 is also under the control of the microprocessor.

Figure 3:
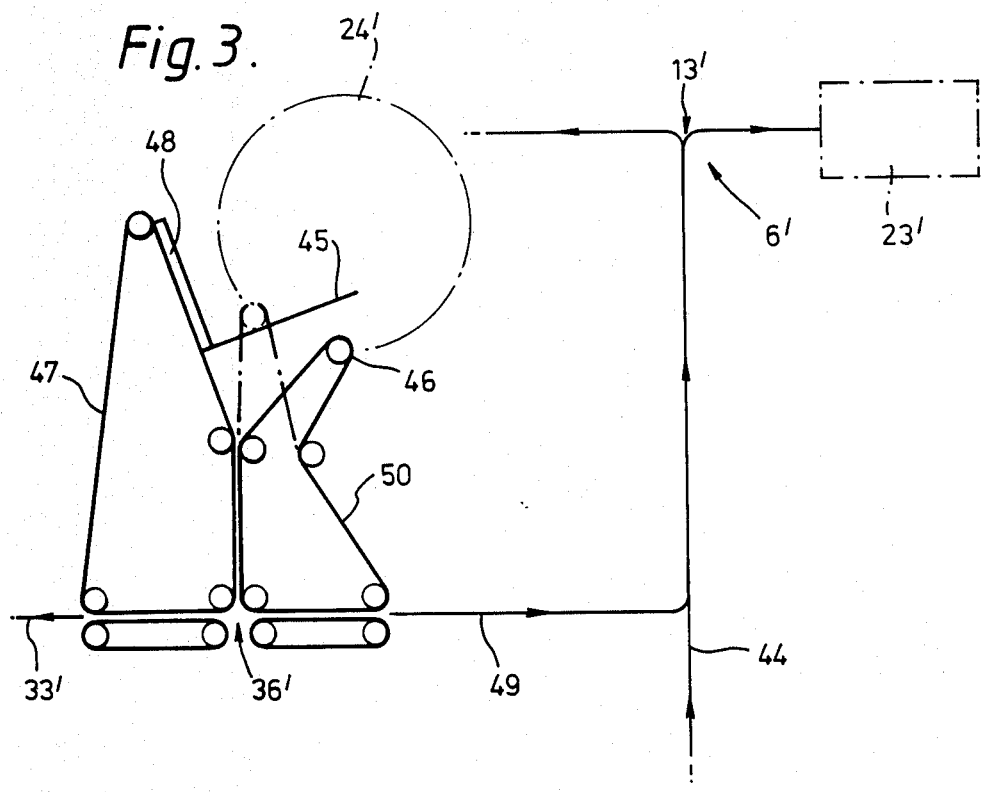
FIG. 3 illustrates part of a second example of dispensing apparatus.

FIG. 3 illustrates a second example of banknote dispensing apparatus. The drawing is mainly schematic and it should be understood that the feed paths shown can be constructed in practice by using sets of endless belts in a similar way to that shown in FIG. 1. In this example, banknotes are fed through a detection module (not shown) similar to the module 1 shown in FIG. 1 along a feed path 44 to a diverting station 6'. The diverting station 6' includes a guide member 13' which is operable under the control of a microprocessor to guide the sheets either to stacking wheels 24' or a dump cassette 23'. The stacking wheels 24' are rotatable in an anti-clockwise direction. A stripper plate 45 extends between the stacking wheels 24' and notes carried in the stacking wheels 24' are stripped off the stacking wheel by the stripper plate 45 to form a stack 48. When the stack is complete, pivoting pinch rollers 46 are pivoted in an anti-clockwise direction to urge the stack of sheets against support belts 47 (shown in phantom in FIG. 3). At this point, the stripper plate 45 is pivoted away from the stack 48. A guide member 36' is then moved to a suitable position for guiding the stack of notes 48 either to a dispense outlet 33' or to a dump feed path 49. The belts 47 and belts 50 together with other belts (not shown) making up the feed path are then rotated (probably at a speed reduced from that for feeding notes to the stack) and the stack of notes 48 is then fed either to the dispense outlet 33' or along the feed path 49 to the guide member 13' which is arranged to direct the stack of notes to the dump cassette 23'.

If the stack of notes is fed to the dispense outlet 33' its final position can be controlled by a photosensor or by measured transport movement.

We claim:

1. Sheet dispensing apparatus comprising:

a dispense outlet;

a dump;

a first diverter;

a second diverter;

a first conveying means for dispensing sheets along a feed path defined by said first conveying means to said first diverter;

second conveying means for conveying sheets from said first diverter to a stacking position;

stacking means downstream of said first diverter at said stacking position for stacking sheets;

reject conveying means for conveying sheets from said first diverter along a first reject path to said dump and for conveying stacked sheets from said second diverter along a second reject path to said dump;

detection means for detecting unsuitable sheets in accordance with predetermined criteria;

said first diverter including a movable guide cooperating with said first, second, and reject conveying means whereby in a first position said first diverter guides sheets from said feed path to said second conveying means, said first diverter being movable in response to an output sginal from said detection means to a second position in which detected unsuitable sheets are diverted along said reject conveying means via said first reject path to said dump;

third conveying means for selectively delivering said stacked sheets to said second diverter, said second diverter downstream of said stacking means being selectively movable to cause said third conveying means to convey said stacked sheets either to said dispense outlet or to said reject conveying means which conveys said stacked sheets along a second reject path, a portion of which includes at least a portion of said first reject path, to said dump.

2. Apparatus according to claim 1, wherein said stacking means comprises a rotatable member having a plurality of radially outwardly extending tines for receiving sheets from said feed path; and stripper means cooperating with said rotatable member for stripping sheets from said rotatable member to form a stack of sheets, said stripper means being pivotable from a first position in which sheets are stripped from said rotatable member to a second position in which said stack of sheets is urged into engagement with said second conveying means.

3. Apparatus according to claim 2, wherein said stripper means comprises at least one movable conveyer.

4. Apparatus according to claim 1, wherein said third conveying means comprises an upright portion against at least a part of which sheets are stacked by said stacking means.

5. Banknote dispensing apparatus comprising:

an output station;

a dump;

a first diverter;

a second diverter;

a first conveying means for dispensing banknotes along a feed path defined by said first conveying means to said first diverter;

second conveying means for conveying banknotes from said first diverter to a stacking position;

stacking means downstream of said first diverter at said stacking position, said stacking means including a rotatable member having a plurality of radially outwardly opening slots for receiving banknotes from said second conveying means;

reject conveying means for conveying banknotes from said first diverter a long a first reject path to said dump and for conveying stacked sheets from said second diverter along a second reject path to said dump;

detection means for detecting unsuitable banknotes in accordance with predetermined criteria;

said first diverter including a movable guide cooperating with said first, second, and reject conveying means whereby in a first position said first diverter guides banknotes from said feed path to said second conveying means, said first diverter being movable in response to an output signal from said detection means to divert detected unsuitable sheets along said reject conveying means via said first reject path to said dump;

third conveying means for selectively delivering said stacked banknotes from said stacking position to said second diverter;

said second diverter downstream of said stacking means being selectively movable to cause said third conveying means to convey said stacked banknotes either to said dispense outlet or to said reject conveying means which conveys said stacked sheets along a second reject path, a portion of which includes at least a portion of said first reject path, to said dump; and pivotable stripper means including a movable conveyor which is pivotable between a first position in which it acts to strip banknotes from said rotatable member to form a stack of banknotes and a second position in which said stack of banknotes is sandwiched between said stripper means and said third conveying means, said stripper means being movable in said second position in cooperation with said third conveying means to transport said stacked banknotes towards said output station.

6. Banknote dispensing apparatus according to claim 5, wherein said first, second, third, and reject conveying means comprise respective cooperating feed belts.

* * * * *